US005570745A

United States Patent [19]

MacDonald, III

[11] Patent Number: 5,570,745

[45] Date of Patent: Nov. 5, 1996

[54] RELOCATABLE SPRINKLER ASSEMBLAGE

[75] Inventor: Norman J. MacDonald, III, Lunenburg, Mass.

[73] Assignee: PNM, Inc., Boxborough, Mass.

[21] Appl. No.: 455,026

[22] Filed: May 31, 1995

[51] Int. Cl.[6] ..... A62C 37/50

[52] U.S. Cl. ..... 169/16; 169/37; 169/51; 239/288.5

[58] Field of Search ..... 169/51, 5, 16, 169/17, 18, 37, 38, 39, 40, 41, 90, 91; 239/288, 288.3, 288.5; 137/377, 382, 559

[56] References Cited

U.S. PATENT DOCUMENTS

| | | | |
|---|---|---|---|
| 2,017,841 | 10/1935 | Coleman | 169/16 X |
| 2,297,808 | 10/1942 | Soucy | 169/61 |
| 2,890,758 | 6/1959 | Pfalzgraff et al. | 169/37 |
| 2,988,150 | 6/1961 | Smith | 169/56 |
| 2,989,348 | 6/1961 | Reed | 405/2 |
| 3,052,303 | 9/1962 | Lapp | 169/56 |
| 3,388,747 | 6/1968 | Hodnett | 169/39 |
| 3,403,733 | 10/1968 | Terry | 169/49 |
| 3,727,695 | 4/1973 | Danton | 169/37 |
| 3,763,936 | 10/1973 | Menage | 169/45 |
| 3,871,458 | 3/1975 | Dumazet | 169/45 |
| 4,519,458 | 5/1985 | Kroeter | 169/56 |
| 4,633,967 | 1/1987 | Kranz | 180/274 |
| 4,664,197 | 5/1987 | Leduc et al. | 169/26 |
| 4,706,759 | 11/1987 | Grasseschi | 169/51 |
| 4,964,470 | 10/1990 | Gaulin | 169/56 |
| 5,327,976 | 7/1994 | Hattori | 169/16 X |
| 5,396,959 | 3/1995 | MacDonald | 169/51 |

FOREIGN PATENT DOCUMENTS

| | | | |
|---|---|---|---|
| 5-329222 | 12/1993 | Japan | 169/16 |

*Primary Examiner*—Andrew C. Pike
*Attorney, Agent, or Firm*—Morse, Altman & Benson

[57] ABSTRACT

A relocatable sprinkler assemblage can be safely relocated while pressurized and operational and does not effect the temperature sensitivity of the sprinkler head. The assemblage includes: (a) a rigid fitting communicating with a flexible sprinkler conduit, the fitting having a conduit end and a head end; (b) the fitting having an unthreaded outer surface adjacent to the conduit end and a threaded outer surface adjacent to the head end; (c) the fitting having an interior surface concentric about the axis of the fitting, the diameter of the inner surface at the head being less than the diameter of the interior surface at the conduit end; (d) a sprinkler head having an externally threaded cylindrical pipe and a thermally sensitive plug, the externally threaded cylindrical pipe being turned into the interior threaded surface of the fitting; (f) a rigid cup with an internal thread at the mouth adapted to be turned onto the head end threaded outer surface, the attachment being substantially watertight; (g) the cup being a transparent polymer for determining the activation condition of the sprinkler head; and (h) the fitting having a threaded outer surface that fits into a hole in a ceiling and is clamped to the ceiling by a threaded nut turned onto the threaded outer surface.

17 Claims, 13 Drawing Sheets

RELOCATABLE SPRINKLER ASSEMBLAGE

BACKGROUND OF THE INVENTION

1. Field of the Invention

The present invention relates generally to sprinkler systems and, more particularly, to the protection of sprinkler heads during relocation.

2. The Prior Art

Sprinkler systems are in wide use today in office buildings, factories, and some homes. One such sprinkler system is disclosed in U.S. Pat. No. 5,396,959, entitled Sprinkler System and issued to Norman MacDonald. The sprinkler system includes a sprinkler head, a water supply, a flexible conduit connecting the water supply to the sprinkler head, and a means for mounting the sprinkler head. The sprinkler head extends into the chamber being protected through holes in tiles that are supported by a lattice suspended from the ceiling.

A different type of mounting arrangement exists for installation in a clean room. The sprinkler heads cannot extend through tiles because the tiles are replaced by heavy filter assemblies. Thus, the sprinkler heads extend through holes in the lattice members themselves.

Regardless of the type of sprinkler system or the environment in which is it used, the head has a temperature-sensitive valve that regulates the flow of water. When the temperature in the vicinity of the valve rises above a predetermined level, the valve opens, allowing the water to run through the valve. Typically, the head is configured so that the water is sprayed over a large area when the valve opens.

In some instances, a sprinkler head must be relocated. Because the valve is sensitive to temperature, it tends to be very fragile and sensitive to physical movement and to impacts as well. Thus, under normal circumstances, relocation requires that the sprinkler system be shut down and completely drained beforehand in order to avoid an accident with an operational sprinkler head that can cause injury to people and damage to equipment. In some instances, however, it is necessary to relocate the sprinkler heads while the system is under pressure and fully operational. This is especially true in clean rooms and hazardous environments where regulations and insurance requirements dictate that the sprinkler system must always remain fully operational. Thus, some type of protection device is needed to protect the head from activating while being relocated.

There are several different protection caps in existence for sprinkler heads. Two such caps are disclosed in U.S. Pat. No. 2,890,758, issued to R. M. Pfalzgraff et al., and U.S. Pat. No. 3,388,747, issued to R. M. Hodnett. These caps are designed to protect the temperature-sensitive sprinkler head from chemical corrosion and mechanical stress, respectively, during normal operation, thus they permanently cover the sprinkler head. They are not designed to act as temporary protection while the sprinkler head is being relocated. When the sprinkler head is not subjected to chemical corrosion or mechanical stress in the operating environment, temporary protection is desired because it does not affect the normal operation of the head. Permanent covers can affect the operation of the head by decreasing its sensitivity to temperature changes. With a temporary cover, protection is only provided when the head is being relocated, and, therefore, does not affect its sensitivity.

Thus, there continues to be a need for a device that physically protects a pressurized and operational sprinkler head temporarily while the head is being relocated.

SUMMARY OF THE INVENTION

The principal object of the present invention is to overcome the disadvantages of the prior art by providing a sprinkler assemblage that can be safely relocated while pressurized and operational and that does not effect the temperature sensitivity of the sprinkler head when not being relocated. The sprinkler assemblage of the present invention is used in a sprinkler system having a hydraulic distribution, a grid of flexible conduits operatively feeding therefrom, a plurality of sprinkler assemblages having operative connections thereto, and a plurality of mounts for enabling transportation of the sprinkler assemblages about the system while maintaining the operative connections. The assemblage includes: (a) a rigid fitting communicating with one of the flexible conduits, the fitting having a longitudinal axis, a conduit end at one end of the axis, and a head end at the other end of the axis; (b) the fitting having an unthreaded outer surface adjacent to the conduit end and an outer surface adjacent to the head end; (c) the fitting having an interior surface concentric about the axis, the interior surface including an interior threaded surface extending within the head end surface, an interior conical surface extending from the interior threaded surface, and an interior cylindrical surface extending from the interior conical surface within the conduit end surface to the conduit end, the diameter of the interior threaded surface being less than the diameter of the interior cylindrical surface; (d) a sprinkler head having an externally threaded cylindrical pipe and a thermally sensitive plug; (e) the externally threaded cylindrical pipe being turned into the interior threaded surface of the fitting; (f) the plug blocking fluid from exiting the pipe at normal room temperatures and melting to unblock the pipe at predetermined elevated temperatures; (g) a cap adapted to fit over the sprinkler head and to removably attach to the fitting, the attachment being substantially watertight; (h) a means for determining the activation condition of the sprinkler head; and (i) a means for mounting the assemblage to one of the mounts.

Preferably, the flexible conduit is composed of an annealed stainless steel braid. One end of the conduit connects to a source of fluid, for example, a rigidly supported, stationary grid of water pipes. The other end of the conduit connects to the fitting.

Preferably, the fitting is a steel or stainless steel hollow tube with a round cross section. The conduit connects to one end of the fitting by one of two methods. In the first method, the end of the conduit has an external thread and the upper end of the fitting has a mating internal thread, where the connection is made by screwing the conduit into the fitting. In the second method, the end of the conduit is permanently bonded to the fitting, for example, by welding.

The other end of the fitting is connected to the sprinkler head. The sprinkler head is shown as a temperature-sensitive sprinkler head with an externally-threaded pipe. The lower end of the inner wall of the fitting is threaded, the threads being adapted to mate with the external threads of the sprinkler head pipe.

There are two preferred embodiments by which the sprinkler assembly of the present invention is mounted to a wall or ceiling of the chamber that is being protected. In the first embodiment, the length of the fitting is divided into three sections, such that the conduit end section extends for about 45% of the length, the intermediate section extends for about 40% of the length, and the head end section extends for the remainder (15%) of the length. Each section has a constant outer diameter, such that the head end section is larger than the overall diameter of the sprinkler head, the intermediate section is larger than the head end section, and the conduit end section is larger than the intermediate section. The intermediate section has an external thread that is adapted to accept a mounting nut. To mount the sprinkler assemblage, the sprinkler head is inserted into a hole in the ceiling lattice of the chamber to be protected and the mounting nut is turned onto the mounting thread.

In the second embodiment, the length of the fitting is divided into two sections, such that the conduit end section extends for about 85% of the length and the head end section extends for the remainder (15%) of the length. Each section has a constant outer diameter, such that the head end section is larger than the overall diameter of the sprinkler head and the conduit end section is larger than the head end section. The preferred method for mounting this embodiment to a suspended ceiling tile is by using a frame having a central hub into which the fitting is mounted. The frame is held in place by the wires that suspend the ceiling tile lattice.

The protective cap preferably is a rigid cup whose inside diameter is large enough to allow the cap to fit over the sprinkler head. The cap is internally threaded at the mouth. The entire length of the head end section of the fitting is externally threaded to accept the internal threads of the cap. Preferably, there is a rubber O-ring around the inside of the cap at the lower end of the threads. The O-ring makes contact with the lower edge of the fitting when the cap is threaded onto the fitting, thereby forming a watertight enclosure encompassing the sprinkler head. In one embodiment, the cap is composed of a transparent plastic. In another embodiment, the cap is composed of an opaque material and has an externally extending valve.

If the sprinkler assemblage must be relocated while still pressurized and operational, the cap is threaded onto the head end section threads until the O-ring contacts the head end edge of the fitting. The cap prevents the sprinkler head from being activated due to physical blows encountered during the relocation. The watertight aspect of the cap prevents injury and damage if the sprinkler head should accidentally activate while being relocated. If the cap is transparent, a visual determination can be made before removing the cap as to whether or not the sprinkler head activated during relocation. If the cap is not transparent, before the cap is removed, the valve is opened to determine if there is fluid in the cap, indicating whether or not the sprinkler head activated during relocation.

Other objects of the present invention will in part be obvious and will in part appear hereinafter.

BRIEF DESCRIPTION OF THE DRAWINGS

For a fuller understanding of the nature and object of the present invention, reference is made to the accompanying drawings, wherein.

DETAILED DESCRIPTION

Figure 1:
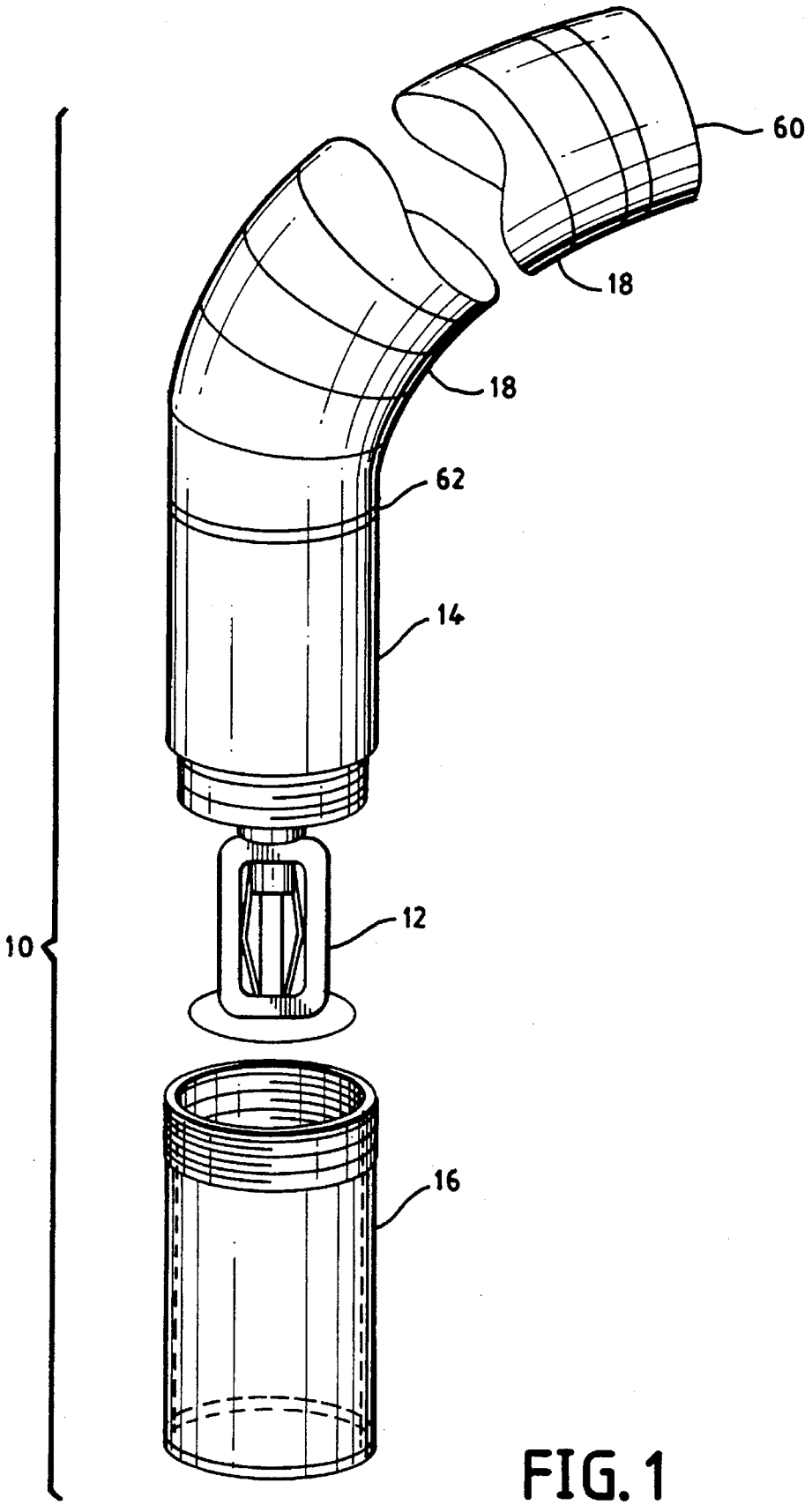
FIG. 1 is a perspective view of the present invention.
Figure 2:
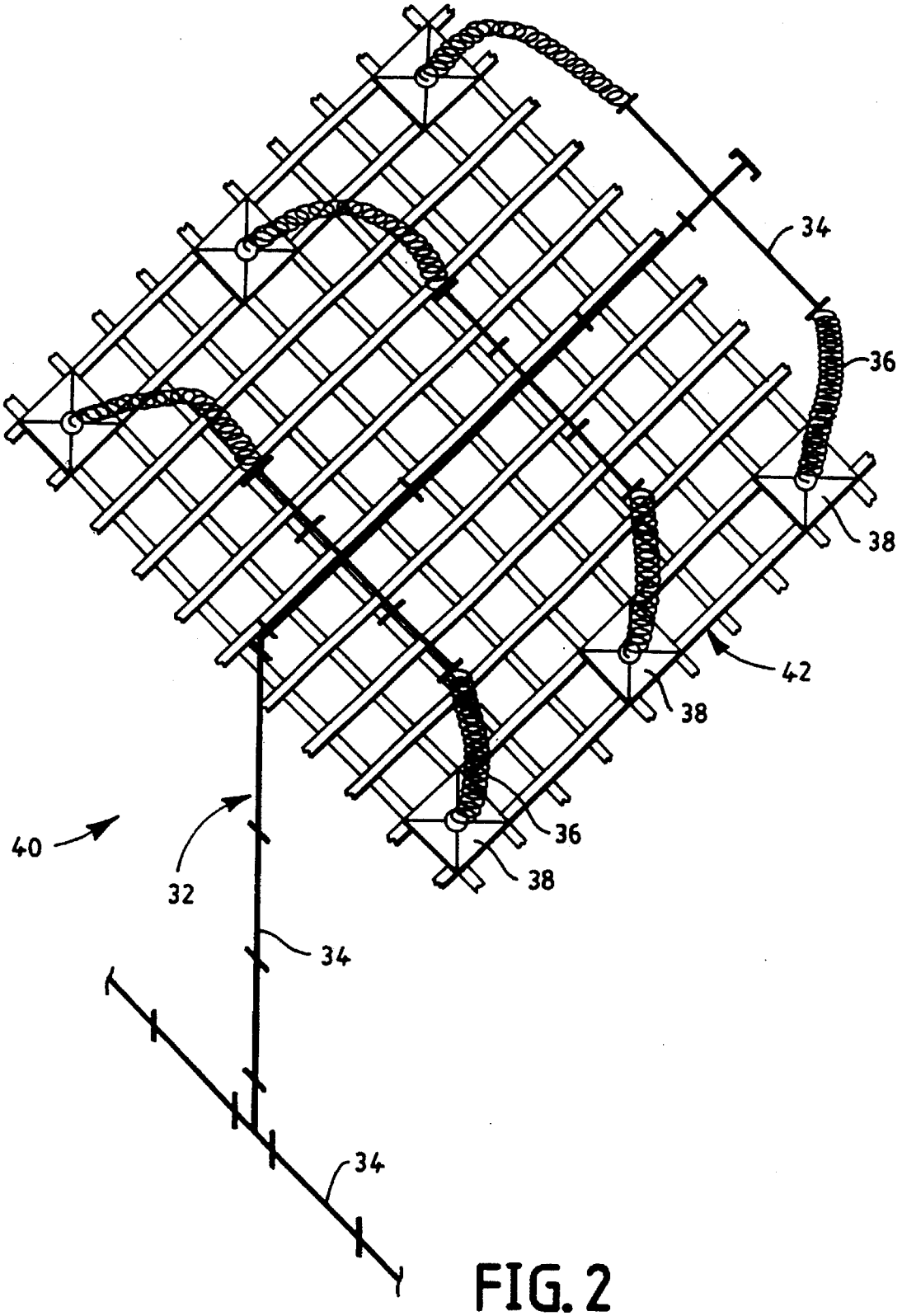
FIG. 2 is a top perspective view of a sprinkler system.
Figure 3:
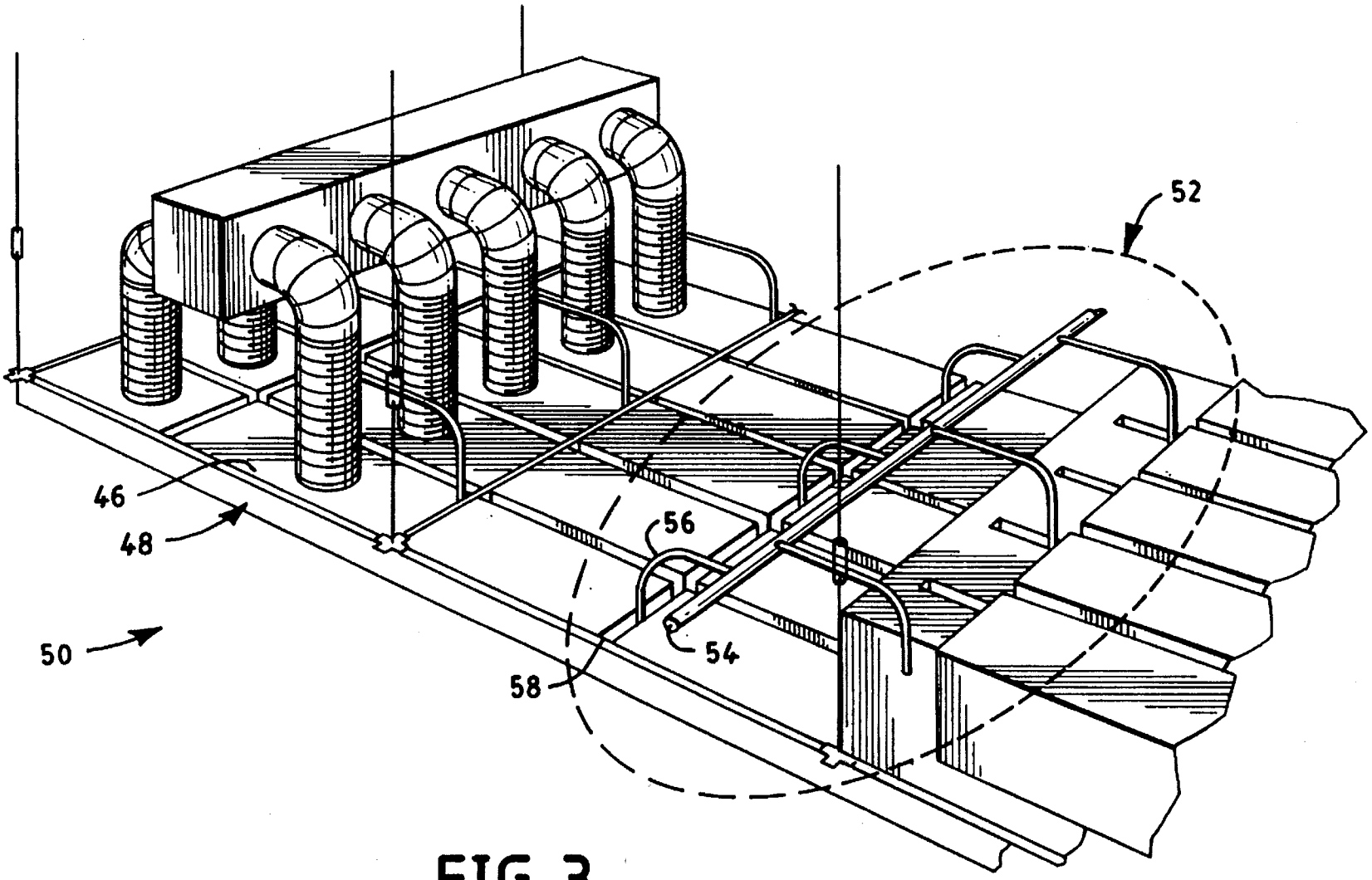
FIG. 3 is a top perspective cut-away view of a sprinkler system for a clean room.

The Sprinkler Assemblage of FIGS. 1 to 3

FIG. 1 shows a perspective view of the relocatable sprinkler assemblage of the present invention 10. The relocatable sprinkler assemblage operates as part of a sprinkler system, an example of which is shown in FIG. 2. The sprinkler system 40 operates in cooperation with a suspended ceiling 42. The sprinkler system 40 includes a rigid, stationary water supply grid 32 comprising a plurality of interconnected pipes 34 rigidly supported above the suspended ceiling 42, and a plurality of flexible sprinkler arms 36 connected to the water supply grid 32 and extending through the suspended ceiling tiles 38.

FIG. 3 shows a cut-away view of a sprinkler system for a clean room 50. It is similar to the previously described system 40 in that it also includes a rigid, stationary water supply grid 52 comprising a plurality of interconnected pipes 54 rigidly supported above the suspended ceiling 48 and a plurality of flexible sprinkler arms 56 connected to the water supply grid 52. Because a sprinkler system 50 for a clean room has large filter assembles 46 in place of the tiles through which the arms 56 cannot extend, the arms 56 extend through the lattice members 58 that support the filters 46. The relocatable sprinkler assemblage of the present invention 10 in effect replaces the flexible sprinkler arm of the typical sprinkler system of the prior art.

The relocatable sprinkler assemblage of the present invention 10 includes a sprinkler head 12, a fitting 14, a cap 16, and a flexible conduit 18.

Preferably, the flexible conduit 18 is composed of an annealed stainless steel braid. One end 60 of the conduit connects to a source of fluid, for example, a rigidly supported, stationary grid of water pipes. The other end 62 of the conduit connects to the fitting 14 as described below.

Figure 4:
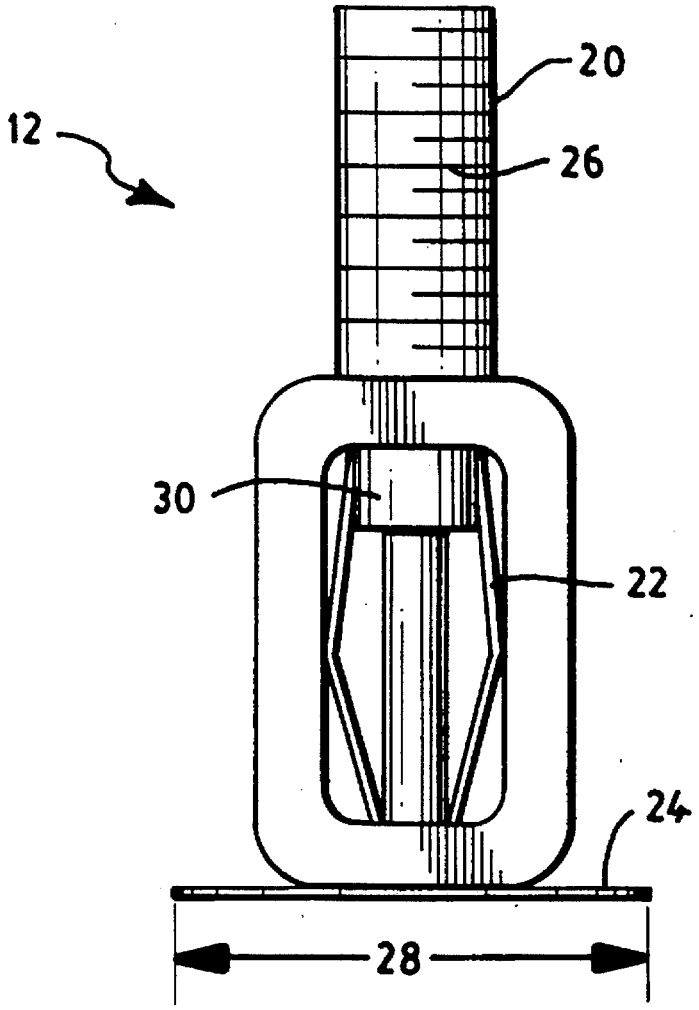
FIG. 4 is a perspective view of the sprinkler head.

The Sprinkler Head of FIG. 4

The sprinkler head 12, as shown in FIG. 4, is a typical prior art, temperature-sensitive sprinkler head designed to be used in sprinkler systems. The sprinkler head 12 is provided with a length of cylindrical pipe 20 that is obstructed by a central plug 30, and pair of flexible links 22 that are designed to melt at about 165° F. When, due to heat and/or fire, the links 22 do melt, the plug 30 is dislodged from the pipe 20 by the force of the water acting against it. The water is dispersed over a large area by a dispersion device 24. The outer surface of the pipe 20 is threaded for connection to the fitting 14 as described below. The overall diameter 28 of the sprinkler head 12 can vary depending on the particular sprinkler head 12 chosen.

The Fittings of FIGS. 5–12

As shown in FIGS. 5–12, there are four preferred embodiments of the fitting 14. The different embodiments are a result of two different preferred methods for attaching the conduit 18 to the fitting 14 and two different preferred methods for mounting the fitting 14 to the ceiling. All preferred embodiments of the fitting 14 are rigid and are preferably composed of steel or stainless steel.

Figure 5:
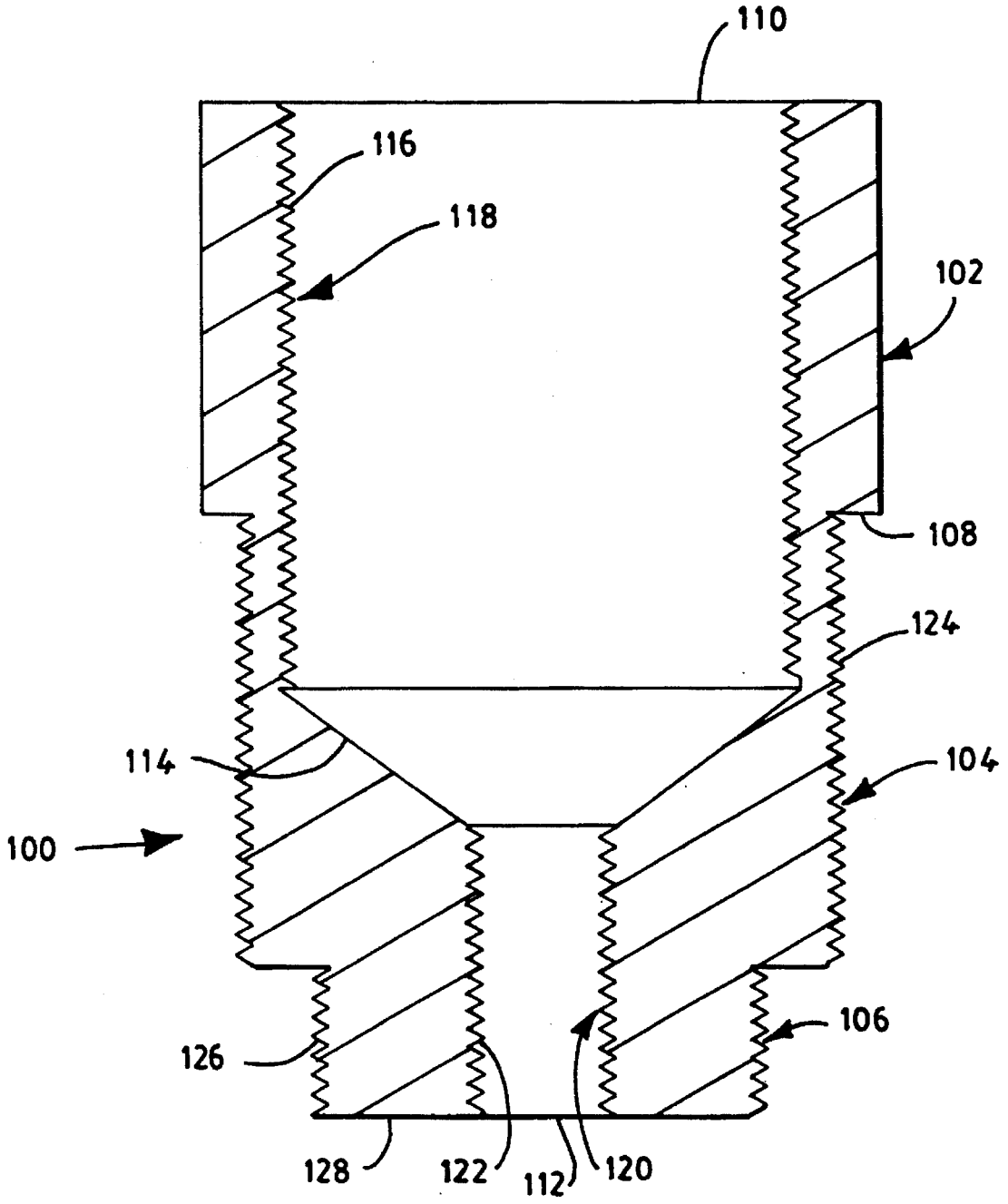
FIG. 5 is a cross-sectional view of the first embodiment of the fitting.
Figure 6:
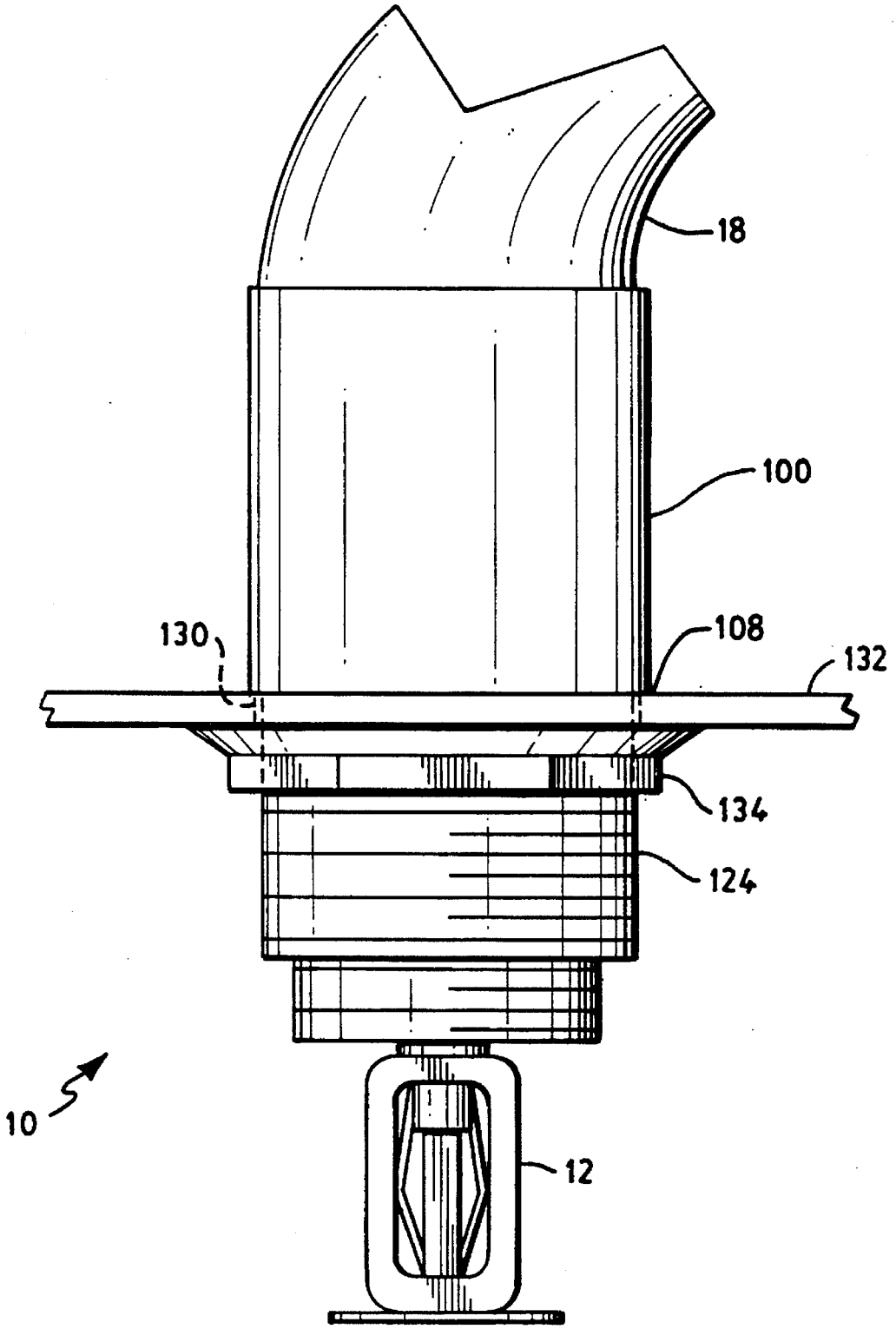
FIG. 6 is a side view of the mounting of the first embodiment of the fitting.

The Fitting of FIG. 5

In the embodiment of FIG. 5, the fitting 100 is a substantially cylindrical tube that is divided into three sections by length. The section 102 at the end in which the conduit is attached extends for about 45% of the length of the fitting 100. In the preferred embodiment, the outside of the conduit end section 102 is unthreaded and has a diameter of about 1½ inches. The intermediate section 104 extends for about 40% of the length of the fitting 100 and has an outside diameter of about 1⅜ inches. A shoulder 108 is located at the junction of the conduit end section 102 and the intermediate section 104. The section 106 at the end in which the sprinkler head is attached accounts for the remaining 15% of the length of the fitting 100 and has an outside diameter of about 1 1/16 inches. In practice, these diameters can vary depending upon the overall diameter of the chosen sprinkler head 28. In all cases, the diameter of the head end section 106 is at least that of the overall diameter of the sprinkler head 28, the diameter of the intermediate section 104 is at least ⅛ inch larger than the diameter of the head end section 106, and the diameter of the conduit end section 102 is at least ⅛ inch larger than the diameter of the intermediate section 104.

The interior surface 116 of the fitting 100 at the conduit end 110 is concentric about the longitudinal axis of the fitting 100 and has a diameter of about 1⅛ inches, and extends into the fitting 100 for about 2½ inches. The interior surface 120 of the fitting 100 at the sprinkler head end 112 is cylindrical, has a diameter of about the same as the outside diameter of the sprinkler head pipe 20, and extends into the fitting 100 for about ⅝ inch. The inside diameter changes substantially monotonically over the distance from the head end inner diameter to the conduit end inner diameter to form a funnel shape, as at 114.

Approximately 1 inch of the inner surface 118 from the conduit end 110 is threaded, where the thread 116 is sized to accept an external thread on the end 62 of the conduit. The entire length of the sprinkler head end inner surface 20 is threaded, where the thread 122 is sized to accept the external thread 26 of the sprinkler head 12. The entire length of the head end section 106 is threaded, where the threads 126 are adapted to mate with the cap 16, as described below.

The outer surface of the intermediate section 104 is threaded. These threads 124 are used to mount the present invention 10 into a hole in a ceiling lattice, such as in the clean room sprinkler system of FIG. 3. As in FIG. 6, the combined sprinkler head 12 and fitting 100 is inserted through a hole 130 in the ceiling 132 until the shoulder 108 is resting on the ceiling 132. A mounting nut 134 that has an annular face 136 perpendicular to the axis of the nut 134 fits over the sprinkler head 12 and is turned onto the mounting threads 124 until the portion of the ceiling adjacent to the hole 130 is securely clamped between the annular face 136 of the nut 134 and the shoulder 158.

Figure 7:
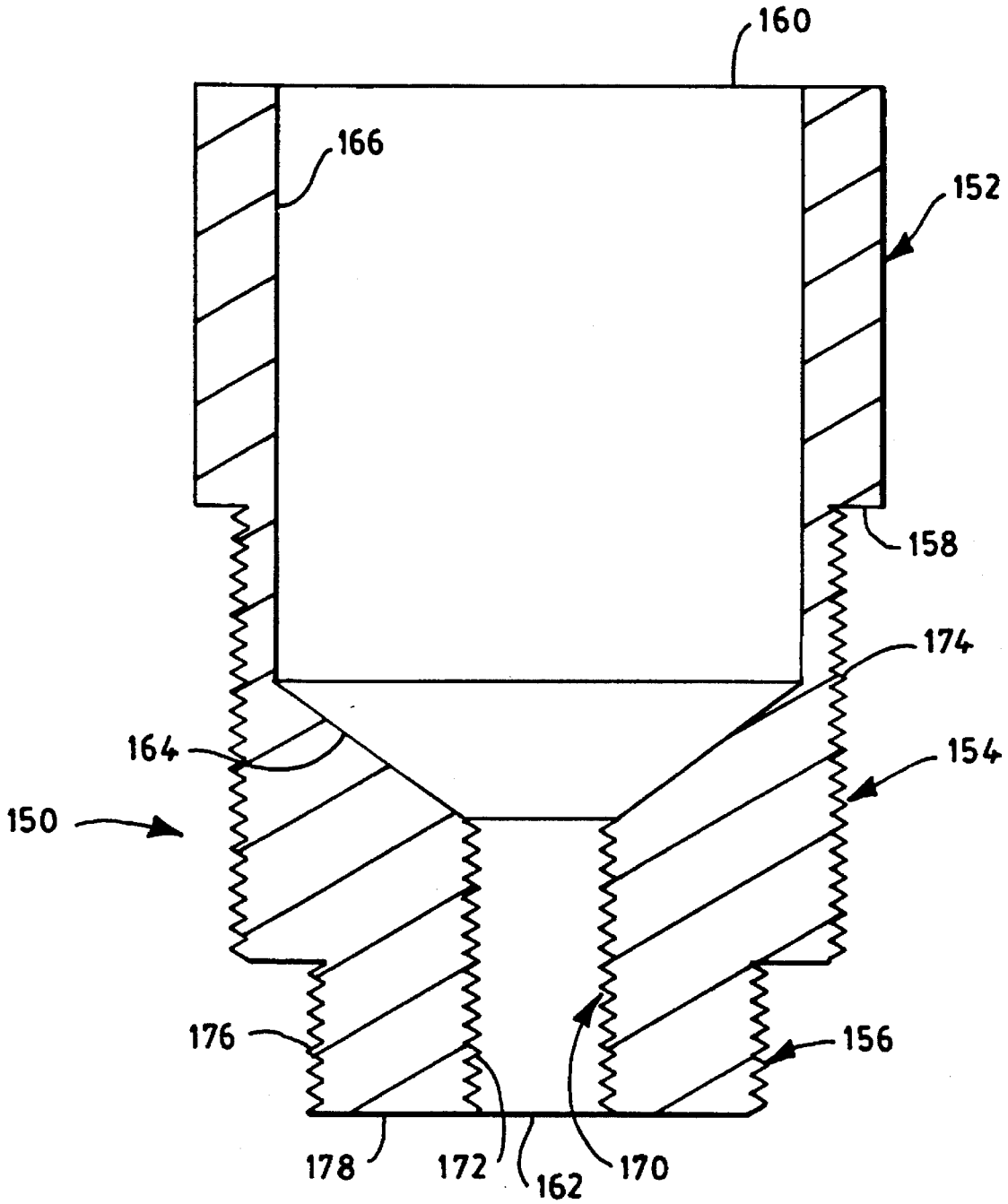
FIG. 7 is a cross-sectional view of the second embodiment of the fitting.
Figure 8:
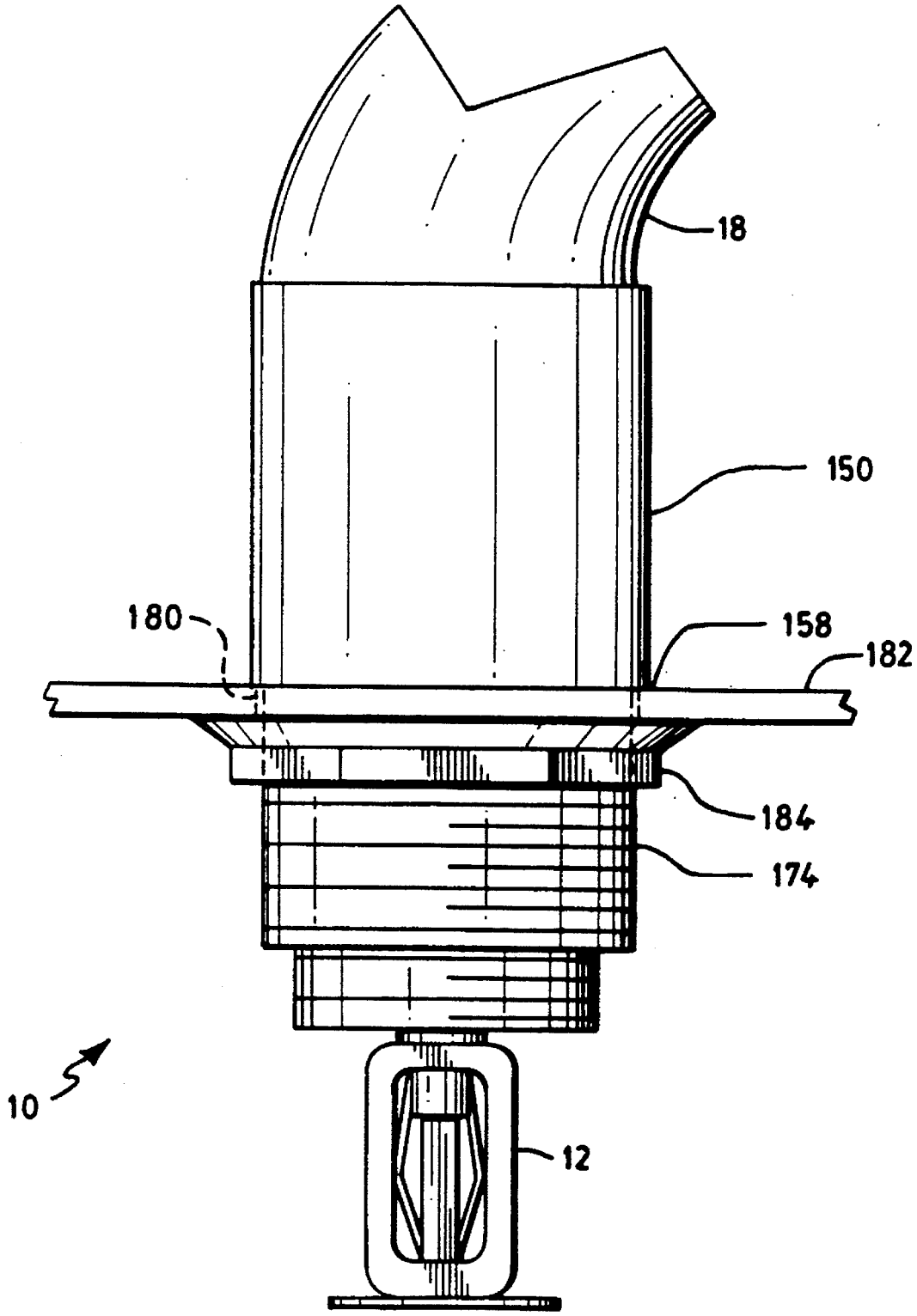
FIG. 8 is a side view of the mounting of the second embodiment of the fitting.

The Fitting of FIG. 7

In the embodiment of FIG. 7, the fitting 150 is a substantially cylindrical tube that is divided into three sections by length. The section 152 at the end in which the conduit is attached extends for about 45% of the length of the fitting 150. In the preferred embodiment, the outside of the conduit end section 152 is unthreaded and has a diameter that is about 1½ inches. The intermediate section 154 extends for about 40% of the length of the fitting 150 and has an outside diameter of about 1⅜ inches. A shoulder 158 is located at the junction of the conduit end section 152 and the intermediate section 154. The section 156 at the end in which the sprinkler head is attached accounts for the remaining 15% of the length of the fitting 150 and has an outside diameter of about 1 1/16 inches. In practice, these diameters can vary depending upon the overall diameter of the chosen sprinkler head 28. In all cases, the diameter of the head end section 156 is at least that of the overall diameter of the sprinkler head 28, the diameter of the intermediate section 154 is at least ⅛ inch larger than the diameter of the head end section 156, and the diameter of the conduit end section 152 is at least ⅛ inch larger than the diameter of the intermediate section 154.

The interior surface 166 of the fitting 150 at the conduit end 160 is concentric about the longitudinal axis of the fitting 150 and has a diameter of about 1⅛ inches, and extends into the fitting 150 for about 2½ inches. The interior surface 170 of the fitting 150 at the sprinkler head end 162 is cylindrical, has a diameter that is about the same as the outside diameter of the sprinkler head pipe 20, and extends into the fitting 150 for about ⅝ inch. The inside diameter changes substantially monotonically over the distance from the head end inner diameter to the conduit end inner diameter to form a funnel shape, as at 164.

The conduit end section 152 is adapted to receive one end 62 of the conduit. The end 62 of the conduit is bonded to the fitting 150 by any permanent method, for example, by welding.

The entire length of the sprinkler head end inner surface 170 is threaded, where the thread 172 is sized to accept the external thread 26 of the sprinkler head 12. The entire length of the head end section 156 is threaded, where the threads 176 are adapted to mate with the cap 16, as described below.

The outer surface of the intermediate section 154 is threaded. These threads 174 are used to mount the present invention 10 into a hole in a ceiling lattice, such as in the clean room sprinkler system of FIG. 3. As in FIG. 8, the combined sprinkler head 12 and fitting 150 is inserted through a hole 180 in the ceiling 182 until the shoulder 158 is resting on the ceiling 182. A mounting nut 184 fits over the sprinkler head 12 and is turned onto the mounting threads 174 until the portion of the ceiling adjacent to the hole 180 is securely clamped between the annular face 186 of the nut 184 and the shoulder 158.

Figure 9:
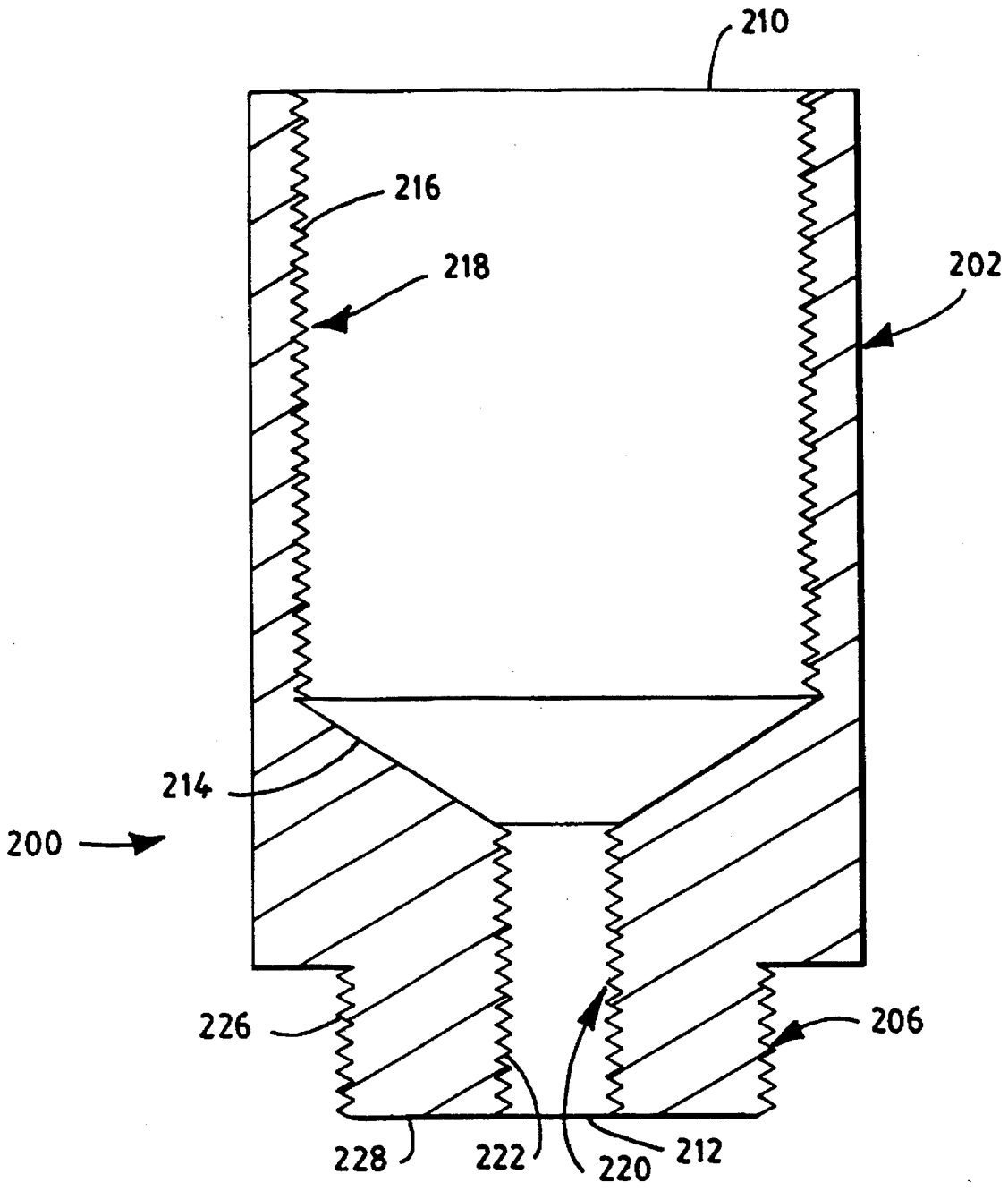
FIG. 9 is a cross-sectional view of the third embodiment of the fitting.

The Fitting of FIG. 9

In the embodiment of FIG. 9, the fitting 200 is a substantially cylindrical tube that is divided into two sections by length. The section 202 at the end in which the conduit is attached extends for about 85% of the length of the fitting 200. In the preferred embodiment, the outside of the conduit end section 202 is unthreaded and has a diameter of about 1½ inches. The section 206 at the end in which the sprinkler head is attached accounts for the remaining 15% of the length of the fitting 200 and has an outside diameter of about 1 1/16 inches. In practice, these diameters can vary depending upon the overall diameter of the chosen sprinkler head 28. In all cases, the diameter of the head end section 206 is at least that of the overall diameter of the sprinkler head 28 and the diameter of the conduit end section 202 is at least 1/8 inch larger than the diameter of the head end section 206.

The interior surface 216 of the fitting 200 at the conduit end 210 is concentric about the longitudinal axis of the fitting 200 and has a diameter of about 1 1/8 inches, and extends into the fitting 200 for about 2 1/2 inches. The interior surface 220 of the fitting 200 at the sprinkler head end 212 is cylindrical, has a diameter that is about the same as the outside diameter of the sprinkler head pipe 20, and extends into the fitting 200 for about 5/8 inch. The inside diameter changes substantially monotonically over the distance from the head end inner diameter to the conduit end inner diameter to form a funnel shape, as at 214.

Approximately 1 inch of the inner surface 218 from the conduit end 210 is threaded, where the thread 216 is sized to accept an external thread on the end of the conduit 62. The entire length of the sprinkler head end inner surface 220 is threaded, where the thread 222 is sized to accept the external thread 26 of the sprinkler head 12. The entire length of the head end section 206 is threaded, where the threads 226 are adapted to mate with the cap 16, as described below.

Figure 10:
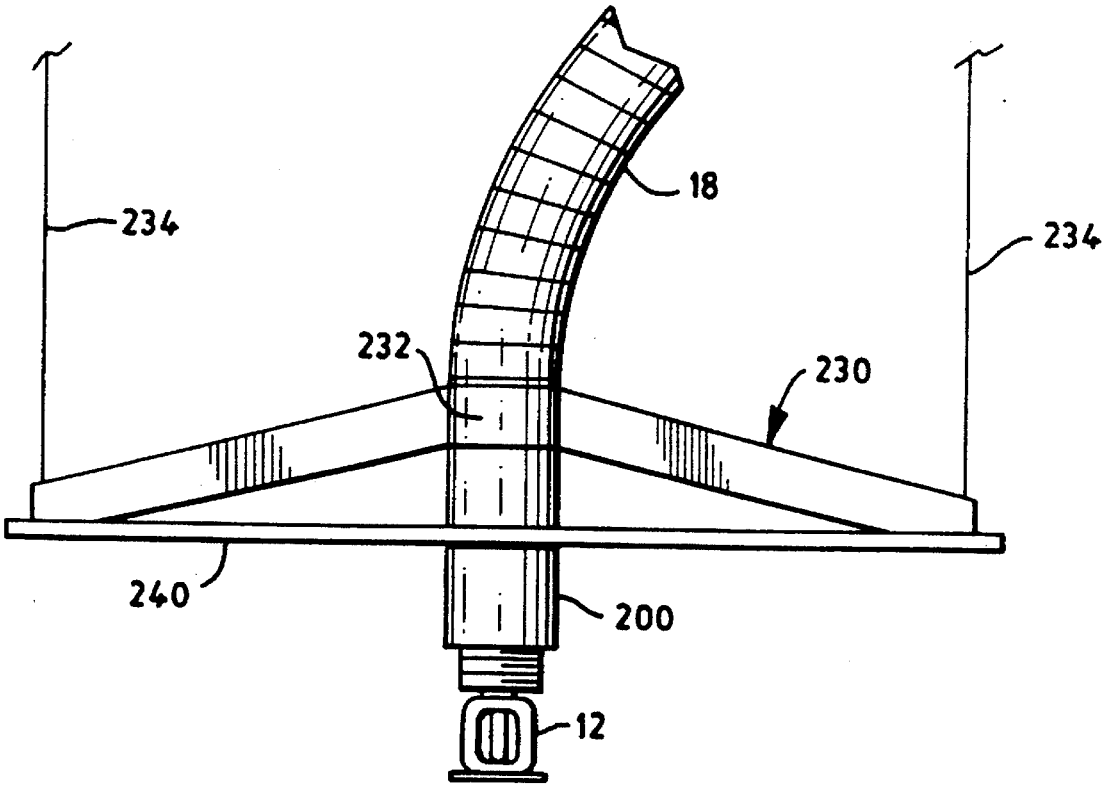
FIG. 10 is a side view of the mounting of the third embodiment of the fitting.

With this embodiment of the fitting 200, as in FIG. 10, the preferred method for mounting the present invention to a suspended ceiling tile 240, as in the sprinkler system of FIG. 2, is by using a frame 230 having a central hub 232 into which the fitting 200 is mounted. The frame 230 is held in place by the wires 234 that suspend the ceiling tile 240.

Figure 11:
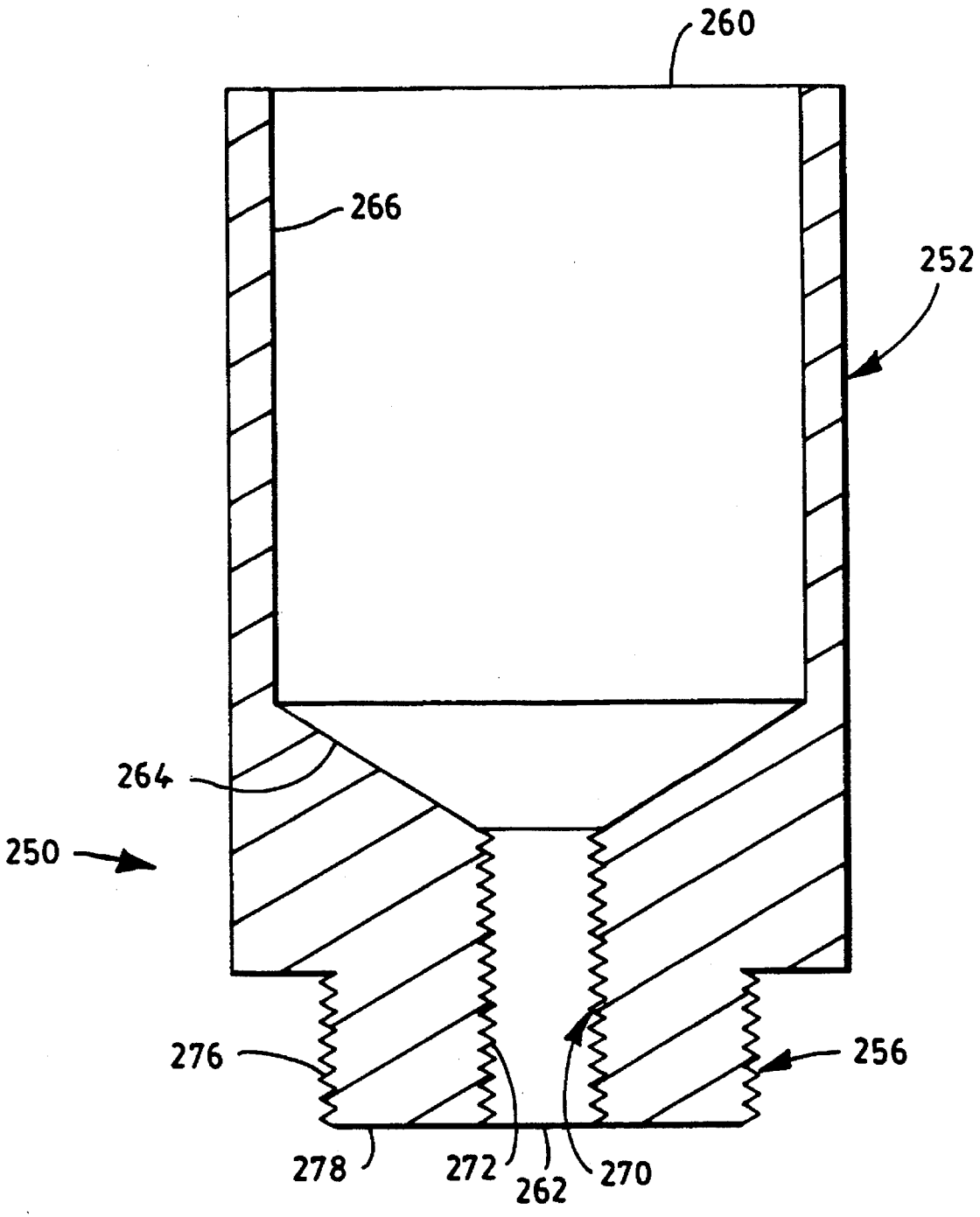
FIG. 11 is a cross-sectional view of the fourth embodiment of the fitting.

The Fitting of FIG. 11

In the embodiment of FIG. 11, the fitting 250 is a substantially cylindrical tube that is divided into two sections by length. The section 252 at the end in which the conduit is attached extends for about 85% of the length of the fitting 250. In the preferred embodiment, the outside of the conduit end section 252 is unthreaded and has a diameter of about 1 1/2 inches. The section 256 at the end in which the sprinkler head is attached accounts for the remaining 15% of the length of the fitting 250 and has an outside diameter of about 1 1/16 inches. In practice, these diameters can vary depending upon the overall diameter of the chosen sprinkler head 28. In all cases, the diameter of the head end section 256 is at least that of the overall diameter of the sprinkler head 28 and the diameter of the conduit end section 252 is at least 1/8 inch larger than the diameter of the head end section 256.

The interior surface 266 of the fitting 250 at the conduit end 260 is concentric about the longitudinal axis of the fitting 250 and has a diameter of about 1 1/8 inches, and extends into the fitting 250 for about 2 1/2 inches. The interior surface 270 of the fitting 250 at the sprinkler head end 212 is cylindrical, has a diameter that is about the same as the outside diameter of the sprinkler head pipe 20, and extends into the fitting 250 for about 5/8 inch. The inside diameter changes substantially monotonically over the distance from the head end inner diameter to the conduit end inner diameter to form a funnel shape, as at 264.

The conduit end section 252 is adapted to receive one end 62 of the conduit. The end 62 of the conduit is bonded to the fitting 250 by any permanent method, for example, by welding.

The entire length of the sprinkler head end inner surface 270 is threaded, where the thread 272 is sized to accept the external thread 26 of the sprinkler head 12. The entire length of the head end section 256 is threaded, where the threads 276 are adapted to mate with the cap 16, as described below.

Figure 12:
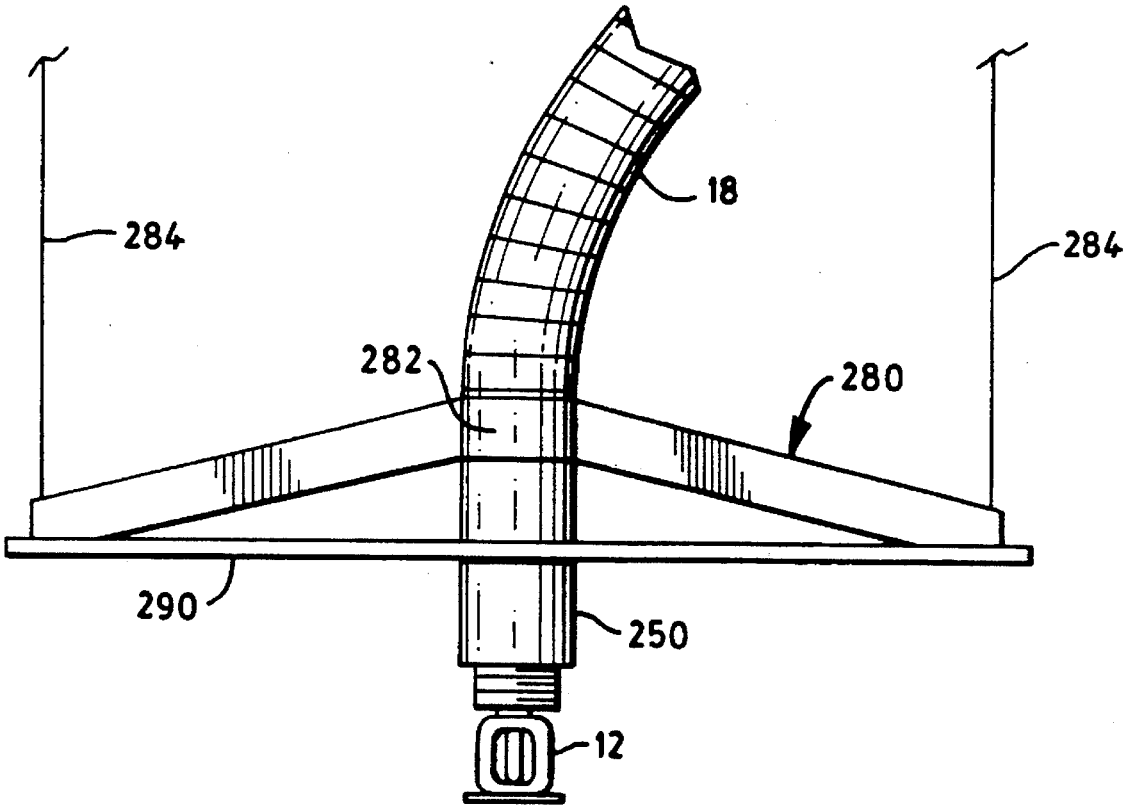
FIG. 12 is a side view of the mounting of the fourth embodiment of the fitting.

With this embodiment of the fitting 250, as in FIG. 12, the preferred method for mounting the present invention to a suspended ceiling tile 290 is by using a frame 280 having a central hub 282 into which the fitting 250 is mounted. The frame 280 is held in place by the wires 284 that suspend the ceiling tile 290.

Figure 13:
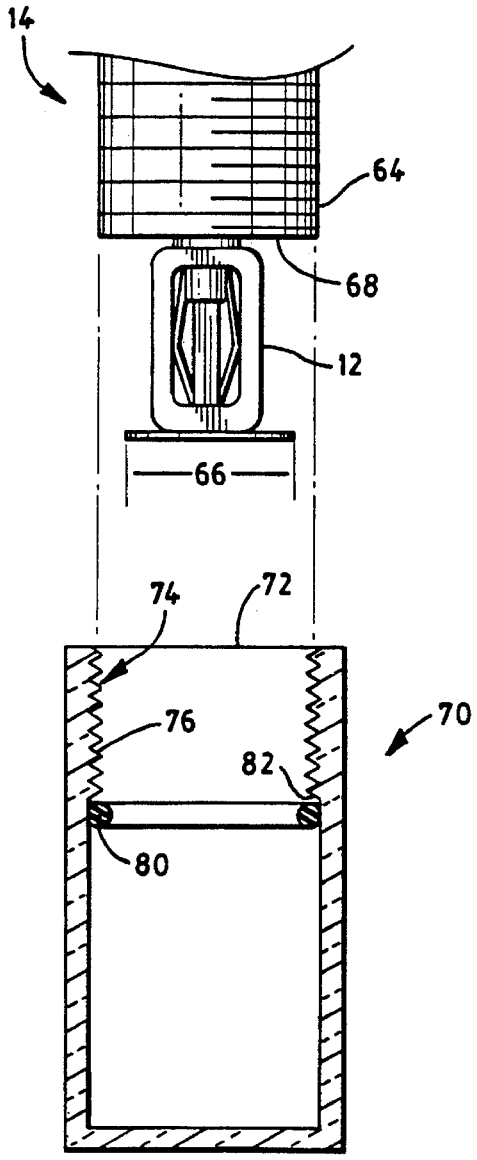
FIG. 13 is a cross-sectional view of one embodiment of the cap.

The Cap of FIG. 13

A cross-sectional view of one embodiment of the cap 70 is shown in FIG. 13. Preferably, the cap 70 is a transparent, rigid polymeric plastic cup that has an inside diameter larger than the overall diameter 66 of the sprinkler head and the same size as the outer diameter of the head end section 64 of the fitting. The thickness of the cap 70 is preferably about 1/8 inch.

The inner surface 74 at the mouth of the cap 72 is threaded, where the threads 76 are sized to mate with external threads of the head end section 64 of the fitting. The cap threads 76 extend about 3/4 inch into the cap 70. A 1/16-inch rubber O-ring 80 is located at the inner extreme of the cap threads 82. When the cap 70 is screwed onto the head end section 64 of the fitting, the O-ring 80 makes contact with the lower edge 68 of the fitting, thereby making a watertight seal between the fitting 14 and the cap 70.

Figure 14:
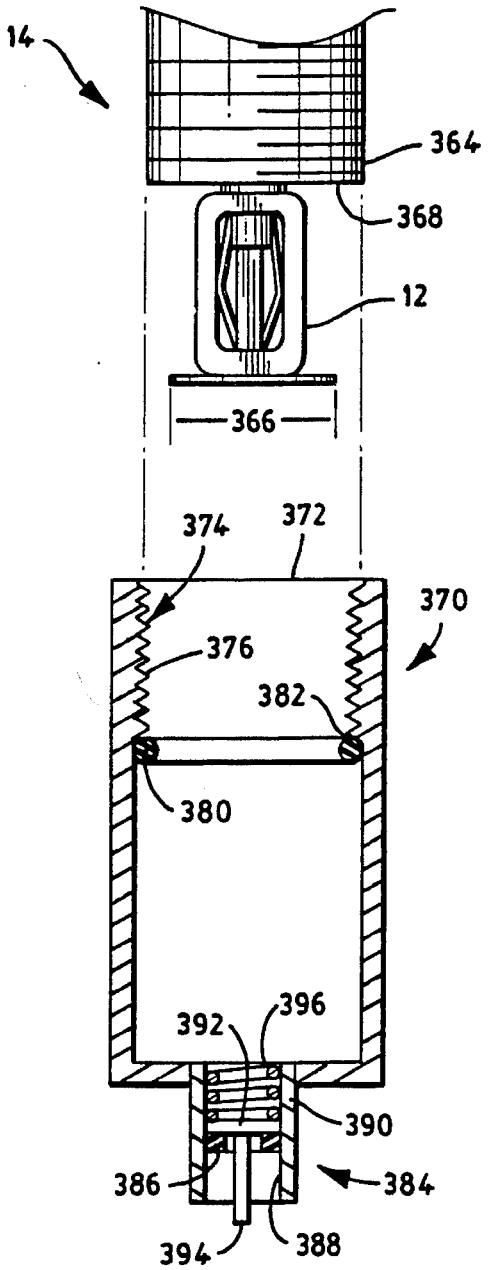
FIG. 14 is a cross-sectional view of another embodiment of the cap.

The Cap of FIG. 14

A cross-sectional view of another embodiment of the cap 370 is shown in FIG. 14. Preferably, the cap 370 is a rigid cup that has an inside diameter larger than the overall diameter 366 of the sprinkler head and the same size as the outer diameter of the head end section 364 of the fitting. The thickness of the cap 370 is preferably about 1/8 inch.

The inner surface 374 at the mouth of the cap 372 is threaded, where the threads 376 are sized to mate with external threads of the head end section 364 of the fitting. The cap threads 376 extend about 3/4 inch into the cap 370. A 1/16-inch rubber O-ring 380 is located at the inner extreme of the cap threads 382. When the cap 370 is screwed onto the head end section 364 of the fitting, the O-ring 280 makes contact with the lower edge 368 of the fitting, thereby making a watertight seal between the fitting 14 and the cap 80.

Extending from the bottom of the cap 370 is a valve 384. The valve 384 is a hollow tube 390 that has a shoulder 386 extending radially from the entire circumference of the interior surface 388 of the tube 390. A circular hatch 392 seats against the upper edge of the shoulder 386 by the force of a spring 396, forming a watertight seal. A pin 394 extends from the bottom side of the hatch beyond the lower edge of the tube 390. When the pin 394 is pushed into the tube 390, against the force of the spring 396, the seal between the shoulder 386 and hatch 392 is opened.

OPERATION

The cap 16 is normally used when it is desired to relocate the sprinkler assemblage 10 while the sprinkler system remains pressurized and operational. However, it can also be used when the sprinkler system is inoperative in order to protect the sprinkler head 12 from damage while being relocated.

To use the present invention 10, screw the cap 16 onto the head end section of the fitting 106, 156, 206, 256 until the O-ring 80 makes solid contact with the lower edge of the fitting 128, 178, 228, 278, thereby making a watertight seal between the fitting 14 and the cap 16 and enclosing the sprinkler head 12. Relocate the sprinkler assemblage 10. If the cap 16 is transparent, remove the cap 16 only if a visual inspection of the sprinkler head 12 through the cap 16 shows that the sprinkler head 12 has suffer no damage. If the cap 16 is not transparent, remove the cap 16 only if no water comes out of the valve 384 when the pin 394 is pushed into the valve tube 390.

What is claimed is:

1. In a sprinkler system having hydraulic distribution, a grid of flexible conduits operatively feeding therefrom, a plurality of sprinkler assemblages having operative connections thereto, and a structure having a lattice and a plurality of tiles, said structure enabling transportation of said sprinkler assemblages about said system while maintaining said operative connections, wherein the improvement comprises at least one of said sprinkler assemblages comprising, along an assemblage axis:

(a) a rigid fitting communicating with one of said flexible conduits, said fitting having a longitudinal axis, a conduit end at one end of said longitudinal axis, and a head end at another end of said longitudinal axis;

(b) said fitting having an unthreaded outer surface adjacent to said conduit end and an outer surface adjacent to said head end;

(c) said fitting having an interior surface concentric about said longitudinal axis, said interior surface including a fitting interior threaded surface extending from said head end within said head end outer surface, an interior conical surface extending from said fitting interior threaded surface, and an interior cylindrical surface extending from said interior conical surface within said conduit end outer surface to said conduit end, a diameter of said fitting interior threaded surface being less than a diameter of said interior cylindrical surface;

(d) a sprinkler head having two operative conditions, one of said conditions being open and another of said conditions being closed;

(e) said sprinkler head having an externally threaded cylindrical pipe and a thermally sensitive plug;

(f) said externally threaded cylindrical pipe being turned into said fitting interior threaded surface;

(g) said plug blocking fluid from exiting said pipe at normal room temperatures and melting to unblock said pipe at predetermined elevated temperatures;

(h) a rigid cup adapted to removably attach to said fitting, forming a substantially watertight attachment and enclosing said sprinkler head in a watertight compartment when said cup is attached to said fitting;

(i) said cup including a means for indicating which one of said two operative conditions exists at a given time; and (j) a means for mounting said one assemblage to said structure.

2. The system of claim 1 wherein said fitting is composed of a material selected from the group consisting of steel and stainless steel.

3. The system of claim 1 wherein said head end outer surface is threaded, said cup has a cup interior threaded surface at a mouth thereof, said cup interior threaded surface being adapted to be turned onto said head end threaded outer surface.

4. The system of claim 3 wherein said watertight attachment includes an O-ring within said cup, said O-ring making contact with said head end of said fitting when said cup is turned onto said head end threaded outer surface.

5. The system of claim 1 wherein said indicating means includes said cup being composed of a transparent polymer to indicate visually which one of said two operative conditions exists at a given time.

6. The system of claim 1 wherein said indicating means includes a valve extending from said cup, said valve being adapted to allow movement of pressurized fluid from inside of said cup to outside of said cup when manually operated.

7. The system of claim 1, said structure including at least one through mounting hole, wherein said means for mounting said one assemblage to said structure includes:

(a) an intermediate threaded outer surface between said conduit end outer surface and said head end outer surface, said intermediate surface extending through said mounting hole;

(b) a diameter of said intermediate threaded outer surface being smaller than a diameter of said conduit end outer surface, forming a shoulder;

(c) a diameter of said head end outer surface being smaller than said diameter of said intermediate threaded outer surface; and (d) an open mounting nut having an interior thread that is turned onto said intermediate threaded outer surface and having an annular face that is adapted to clamp said structure between said annular face and said shoulder.

8. The system of claim 1 wherein said means for mounting said one assemblage to said structure includes a frame with a central hub and legs extending therefrom, said fitting being mounted in said hub.

9. In a sprinkler system having hydraulic distribution, a grid of flexible conduits operatively feeding therefrom, a plurality of sprinkler assemblages having operative connections thereto, and a structure having a lattice and a plurality of tiles, said structure enabling transportation of said sprinkler assemblages about said system while maintaining said operative connections, wherein the improvement comprises at least one of said sprinkler assemblages comprising, along an assemblage axis:

(a) a rigid fitting communicating with one of said flexible conduits, said fitting having a longitudinal axis, a conduit end at one end of said longitudinal axis, and a head end at another end of said longitudinal axis;

(b) said fitting having an unthreaded outer surface adjacent to said conduit end and a threaded outer surface adjacent to said head end;

(c) said fitting having an interior surface concentric about said longitudinal axis, said interior surface including a fitting interior threaded surface extending from said head end within said head end threaded outer surface, an interior conical surface extending from said fitting interior threaded surface, and an interior cylindrical surface extending from said interior conical surface within said conduit end outer surface to said conduit end, a diameter of said fitting interior threaded surface being less than a diameter of said interior cylindrical surface;

(d) a sprinkler head having two operative conditions, one of said conditions being open and another of said conditions being closed;

(e) said sprinkler head having an externally threaded cylindrical pipe and a thermally sensitive plug;

(f) said externally threaded cylindrical pipe being turned into said fitting interior threaded surface;

(g) said plug blocking fluid from exiting said pipe at normal room temperatures and melting to unblock said pipe at predetermined elevated temperatures;

(h) a rigid cup, said cup having a cup interior threaded surface at a mouth thereof, said cup interior threaded surface being adapted to be turned onto said head end threaded outer surface, forming a substantially watertight attachment;

(i) said watertight attachment including an O-ring within said cup, said O-ring making contact with said head end of said fitting when said cup is turned onto said head end threaded outer surface;

(j) a means for indicating which one of said two operative conditions exists at a given time; and (k) a means for mounting said one assemblage to said structure.

10. The system of claim 9 wherein said fitting is composed of a material selected from the group consisting of steel and stainless steel.

11. The system of claim 9 wherein said indicating means includes said cup being composed of a transparent polymer to indicate visually which one of said two operative conditions exists at a given time.

12. The system of claim 9 wherein said indicating means includes a valve extending from said cup, said valve being adapted to allow movement of pressurized fluid from inside of said cup to outside of said cup when manually operated.

13. The system of claim 9, said structure including at least one through mounting hole, wherein said means for mounting said one assemblage to said structure includes:

(a) an intermediate threaded outer surface between said conduit end outer surface and said head end outer surface, said intermediate threaded outer surface extending through said mounting hole;

(b) a diameter of said intermediate threaded outer surface being smaller than a diameter of said conduit end outer surface, forming a shoulder;

(c) a diameter of said head end outer surface being smaller than said diameter of said intermediate threaded outer surface; and (d) an open mounting nut having an interior thread that is turned onto said intermediate threaded outer surface and having an annular face that is adapted to clamp said structure between said annular face and said shoulder.

14. The system of claim 9 wherein said means for mounting said one assemblage to said structure includes a frame with a central hub and legs extending therefrom, said fitting being mounted in said hub.

15. In a sprinkler system having hydraulic distribution, a grid of flexible conduits operatively feeding therefrom, a plurality of sprinkler assemblages having operative connections thereto, and a structure having a lattice and a plurality of tiles, said structure enabling transportation of said sprinkler assemblages about said system while maintaining said operative connections, and said structure having at least one through mounting hole, wherein the improvement comprises at least one of said sprinkler assemblages comprising, along an assemblage axis:

(a) a rigid fitting communicating with one of said flexible conduits, said fitting having a longitudinal axis, a conduit end at one end of said longitudinal axis, and a head end at another end of said longitudinal axis;

(b) said fitting having an unthreaded outer surface adjacent to said conduit end, a threaded outer surface adjacent to said head end, and an intermediate threaded outer surface between said conduit end outer surface and said head end outer surface, said intermediate threaded outer surface extending through said mounting hole;

(c) a diameter of said intermediate threaded outer surface being smaller than a diameter of said conduit end outer surface, forming a shoulder;

(d) a diameter of said head end outer surface being smaller than said diameter of said intermediate threaded outer surface;

(e) said fitting having an interior surface concentric about said longitudinal axis, said interior surface including a fitting interior threaded surface extending from said head end within said head end threaded outer surface, an interior conical surface extending from said fitting interior threaded surface, and an interior cylindrical surface extending from said interior conical surface within said conduit end outer surface to said conduit end, a diameter of said fitting interior threaded surface being less than a diameter of said interior cylindrical surface;

(f) a sprinkler head having an externally threaded cylindrical pipe and a thermally sensitive plug;

(g) said externally threaded cylindrical pipe being turned into said fitting interior threaded surface;

(h) said plug blocking fluid from exiting said pipe at normal room temperatures and melting to unblock said pipe at predetermined elevated temperatures;

(i) a transparent polymeric cup, said cup having a cup interior threaded surface at a mouth thereof, said cup interior threaded surface being adapted to be turned onto said head end threaded outer surface, forming a substantially watertight attachment;

(j) said watertight attachment including an O-ring within said cup, said O-ring making contact with said head end of said fitting when said cup is turned onto said head end threaded outer surface;

(k) an open mounting nut having an interior thread that is turned onto said intermediate threaded outer surface and having an annular face that is adapted to clamp said structure between said annular face and said shoulder; and (l) said fitting being composed of a material selected from the group consisting of steel and stainless steel.

16. In a sprinkler system having hydraulic distribution, a grid of flexible conduits operatively feeding therefrom, a plurality of sprinkler assemblages having operative connections thereto, and a plurality of mounts for enabling transportation of said sprinkler assemblages about said system while maintaining said operative connections, wherein the improvement comprises at least one of said sprinkler assemblages comprising, along an assemblage axis:

(a) a rigid fitting communicating with one of said flexible conduits, said fitting having a longitudinal axis, a conduit end at one end of said longitudinal axis, and a head end at another end of said longitudinal axis;

(b) said fitting having an unthreaded outer surface adjacent to said conduit end and a threaded outer surface adjacent to said head end;

(c) said fitting having an interior surface concentric about said longitudinal axis, said interior surface including a fitting interior threaded surface extending from said head end within said head end threaded outer surface, an interior conical surface extending from said fitting interior threaded surface, and an interior cylindrical surface extending from said interior conical surface within said conduit end outer surface to said conduit end, a diameter of said fitting interior threaded surface being less than a diameter of said interior cylindrical surface;

(d) a sprinkler head having an externally threaded cylindrical pipe and a thermally sensitive plug;

(e) said externally threaded cylindrical pipe being turned into said fitting interior threaded surface;

(f) said plug blocking fluid from exiting said pipe at normal room temperatures and melting to unblock said pipe at predetermined elevated temperatures;

(g) a transparent polymeric cup, said cup having a cup interior threaded surface at a mouth thereof, said cup interior threaded surface being adapted to be turned onto said head end threaded outer surface, forming a substantially watertight attachment;

(h) said watertight attachment including an O-ring within said cup, said O-ring making contact with said head end of said fitting when said cup is turned onto said head end threaded outer surface;

(i) a means for attaching said one assemblage to said structure including a frame with a central hub and legs extending therefrom, said fitting being mounted in said hub; and (j) said fitting being composed of a material selected from the group consisting of steel and stainless steel.

17. In a sprinkler system having hydraulic distribution, a grid of flexible conduits operatively feeding therefrom, a plurality of sprinkler assemblages having operative connections thereto, and a plurality of mounts for enabling transportation of said sprinkler assemblages about said system while maintaining said operative connections, at least one of said mounts having at least one through mounting hole, wherein the improvement comprises at least one of said sprinkler assemblages comprising, along an axis:

(a) a rigid fitting communicating with one of said flexible conduits;

(b) said fitting having an unthreaded external surface, an intermediate externally threaded surface, and a terminal externally threaded surface;

(c) a diameter of said intermediate externally threaded surface being smaller than a diameter of said unthreaded external surface, forming a shoulder;

(d) a diameter of said terminal externally threaded surface being smaller than said diameter of said intermediate externally threaded surface;

(e) said fitting having an interior surface along said axis, said interior surface including an interior cylindrical surface extending within said unthreaded external surface and said intermediate threaded surface, an interior conical surface continuing from said interior cylindrical surface within said intermediate externally threaded surface, and an internally threaded surface extending axially from said interior conical surface and within said terminal externally threaded surface;

(f) a sprinkler head having an externally threaded cylindrical pipe and a thermally sensitive plug;

(g) said externally threaded cylindrical pipe being turned into said internally threaded surface of said fitting;

(h) said plug blocking said cylindrical pipe at normal temperatures and melting to open said cylindrical pipe at predetermined elevated temperatures;

(i) a transparent polymeric cup having a threaded interior surface at a mouth thereof;

(j) said threaded interior surface of said cup being adapted to be turned onto said terminal externally threaded surface of said fitting in order to contain a flow of fluid through said pipe if there is damage to said head; and (k) an open mounting nut having an interior thread that is turned onto said intermediate externally threaded surface of said fitting and an annular face that is adapted to clamp said one mount between said annular face and said shoulder after inserting said terminal externally threaded surface and said intermediate externally threaded surface through said mounting hole.

* * * * *